United States Patent [19]

Suguri

[11] Patent Number: 4,878,291

[45] Date of Patent: Nov. 7, 1989

[54] METHOD OF MANUFACTURING TOROIDAL COILS

[75] Inventor: Kazuhiko Suguri, Kanagawa, Japan

[73] Assignee: Harada Kogyo Kabushiki Kaisha, Tokyo, Japan

[21] Appl. No.: 128,701

[22] Filed: Dec. 4, 1987

[51] Int. Cl.[4] ..... H01F 41/02; H01F 27/30

[52] U.S. Cl. ..... 29/606; 29/760; 336/223; 336/229

[58] Field of Search ..... 29/760, 745, 605, 606; 336/229, 223, 222

[56] References Cited

U.S. PATENT DOCUMENTS

| | | | |
|---|---|---|---|
| 1,852,805 | 4/1932 | Frank | 336/223 |
| 3,025,452 | 3/1962 | Ross | 336/229 X |
| 3,564,708 | 2/1971 | Harris | 336/208 X |
| 3,638,156 | 1/1972 | West | 336/223 |
| 4,024,370 | 5/1977 | Sciaky | 336/229 X |
| 4,103,267 | 7/1978 | Olschewski | 336/229 X |
| 4,297,665 | 10/1981 | Paton et al. | 336/229 X |

FOREIGN PATENT DOCUMENTS

| | | | |
|---|---|---|---|
| 36716 | 3/1956 | Fed. Rep. of Germany | 336/229 |
| 622261 | 5/1927 | France | 336/229 |
| 128805 | 10/1980 | Japan | 336/229 |

*Primary Examiner*—Thomas J. Kozma
*Attorney, Agent, or Firm*—Koda and Androlia

[57] ABSTRACT

A toroidal coil device used in a circuit of an automobile radio receiver as an element for blocking AM waves, including a ring core, U shaped first conductive members arranged on the core at circumferentially equal intervals, and second conductive members mounted on the first conductive members such that the inner end of each first conductive member is connected to the outer end of the next first conductive member. In addition, the toroidal coil is assembled in four steps which consist of first producing the first and second conductive members, then by setting the first conductive members in slits which are formed at circumferentially equal intervals on a jig and by also setting the ring core in the thus arranged first conductive members, and then mounting the second conductive members on the first conductive members such that the second conductive members are connected with the inner end of each first conductive member and the outer end of the next first conductive member, and lastly by electrically fastening the first and second conductive members.

3 Claims, 5 Drawing Sheets

FIG.3a
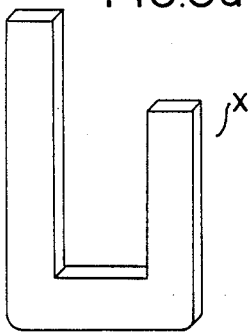
FIG3b
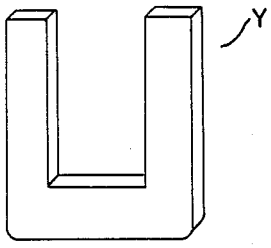
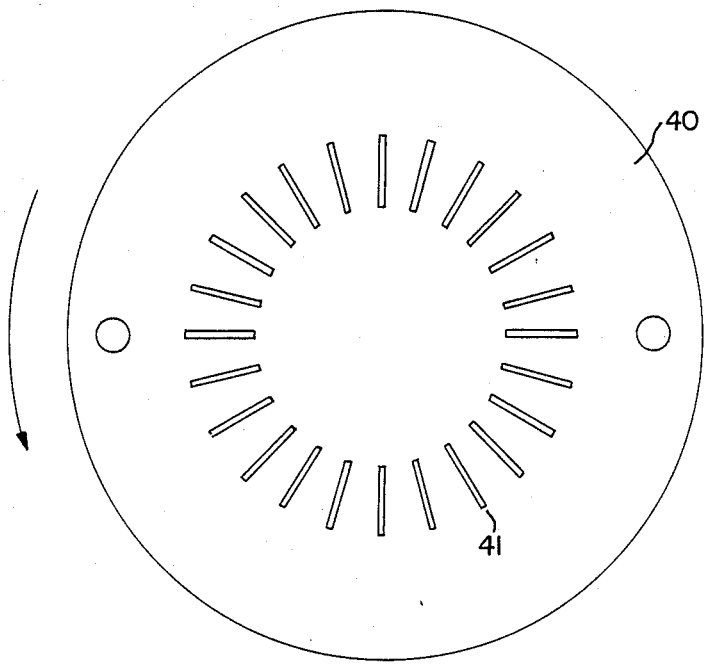
FIG.4

METHOD OF MANUFACTURING TOROIDAL COILS

BACKGROUND OF THE INVENTION

1. Field of the Invention

The present invention relates to a toroidal coil device used in, for example, radio receivers for automobiles which blocks AM signals and further relates to a method for manufacturing the toroidal coil device.

2. Prior Art

FIG. 11 illustrates a circuit diagram of a radio receiver used in automobiles.

In FIG. 11 an antenna 1 made of a conductive film is mounted on the rear windshield of an automobile. The feeding terminal of this antenna 1 is connected to input terminals 2*a* and 2*b* of the antenna, and to the input terminals 2*a* and 2*b*, an FM circuit 3 and an AM circuit 4 are connected respectively. Provided between the input terminals 2*a* and 2*b* and the AM circuit 4 is a choke coil 5 which blocks the FM signals. Also, between the connecting point of the choke coil 5 and the AM circuit 4 and a power source circuit 6, a toroidal coil 7 which blocks the AM signals is provided. Usuallu, the toroidal coil 7 is manufactured by an automatic winding machine which winds the conductive wires around a ring-shaped toroidal core. The toroidal coil may also be manufactured manually by winding the conductive wires around a ring-shaped core.

When a current as high as $20 \propto 30$ amperes flows through the thus manufactured toroidal coil, the conductive wire used therein coil must have a very large diameter. However, when wire of a lesser specific diameter is used, it is very difficult, if not impossible, to wind the wire around the core accurately. As a result, it is very likely that the wire will be wound unevenly during the manufacturing process.

As mentioned above, a large amount of current may occasionally flow through the toroidal coil. Also in order to cancel magnetic flux in the toroidal coil, current may flow in the opposite direction through the coil. Accordingly, when the way in which the wire is wound is varied even a little, the core may become saturated. Thus, a toroidal coil with high precision wire winding is very much desired.

SUMMARY OF THE INVENTION

It is, therefore, a primary object of the present invention to provide a toroidal coil which has an evenly wound and highly efficient coil winding regardless of the diameter of the wire used.

It is another object of the present invention to provide a method by which such a toroidal coil may be manufactured easily and accurately.

In keeping with the principles of the present invention, the objects are accomplished with a unique structure of a toroidal coil which includes a ring core, a plurality of U shaped first conductive members arranged on the core at constant circumferential intervals, and a plurality of second conductive members securely mounted on the first conductive members such that one end of each second conductive member is placed on the inner end of one of the first conductive members and the other end of the second conductive member is placed on the outer end of the next first conductive member. Thus, the first conductive members are continuously connected via the second conductive members.

Further, the method of the present invention includes four steps: in the first step, the first conductive members are U-shaped and the second conductive members are S-shaped; in the second step, the bottoms of the first conductive members are inserted in slits made into a jig, the slits being arranged at the constant pitch in the circumferential direction of the jig; in the third step, the second conductive members are mounted on the first conductive members so that the inner end of each first conductive member on the jig is connected to outer end of the next first conductive member via the second conductive member; and in the forth step, the ends of the first conductive members are securely fastened via the second conductive members with solder, etc. With the above described structure, a toroidal coil can be manufactured without the necessity of any coil winding operation, and a toroidal coil having an even and high precision coil winding is obtained regardless of the diameter of the coil.

BRIEF DESCRIPTION OF THE DRAWINGS

The above mentioned features and objects of the present invention will become more apparent with reference to the following description taken in conjunction with the accompanying drawings wherein like references denote like elements and in which:

FIG. 2(*b*) is a sectional view taken along the line 2*b*—2*b* of FIG. 1;

FIG. 3(*a*) is a perspective view of an element X;

FIG. 3(*b*) is a perspective view of an element Y;

FIG. 4 is a top plan view of a jig provided with slits;

DETAILED DESCRIPTION OF THE INVENTION

Figure 1:
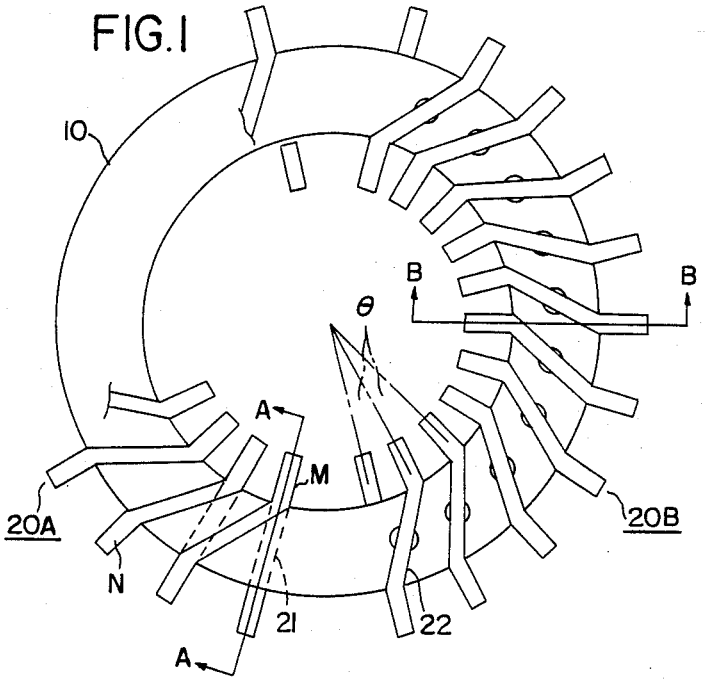
FIG. 1 is a top plan view of the toroidal coil as in a finished product with a part thereof omitted.
Figure 2A:
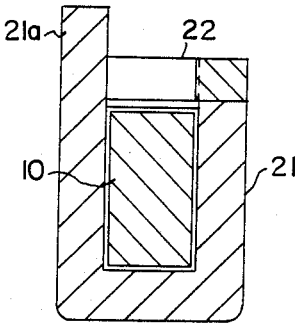
FIG. 2(*a*) is a sectional view taken along the line 2*a*—2*a* of FIG. 1.
Figure 2B:
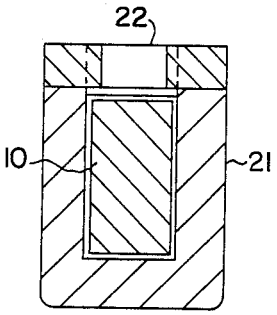

Referring first to FIGS. 1, 2(*a*) and 2(*b*), reference numeral 10 is a ring core made of, for instance, ferrite having a specified inner and outer diameter and thickness. A pair of toroidal coils 20A and 20B are set in the core 10. Each of the toroidal coils is made-up of a plurality of two types of conductive members 21 and 22.

More specifically, the first conductive member 21 is, as seen in FIG. 2(*a*) and 2(*b*), U-shaped and a plurality of the first conductive members 21 are set on the core 10 from one side of the core 10 and arranged at predetermined equal intervals in the circumferential direction of the core (about 15 apart in the drawings). First conductive members 21 are provided with an extending portion 21*a* as shown in FIG. 2(*a*) which is a coil connecting terminal. The second conductive member 22 is a rectangular member bent into a substantially an S-shape. The plan view of the second conductive member is seen in FIG. 1. Both the first and second conductive members are made of a highly conductive material such as copper.

These first and second conductive members are connected with solder after the second conductive members 22 have been mounted on the first conductive members such that the inner end M of each first conductive member 21 is connected to the outer end N of the next first conductive member 21 via the second conductive member 22.

Thus, a pair of toroidal coils 20A and 20B are arranged so that they surround the core 10 spirally via the combinations of the first and second conductive members 21 and 22.

A method for manufacturing the above described toroidal coil device will be explained with reference to FIGS. 3(*a*), 3(*b*) through 9 and 10. The first conductive member 21 having an extending portion 21*a* is called element X, and the first conductive member 21 without a stretched portion 21*a* is called element Y. The second conductive member 22 is called element Z.

Figure 10:
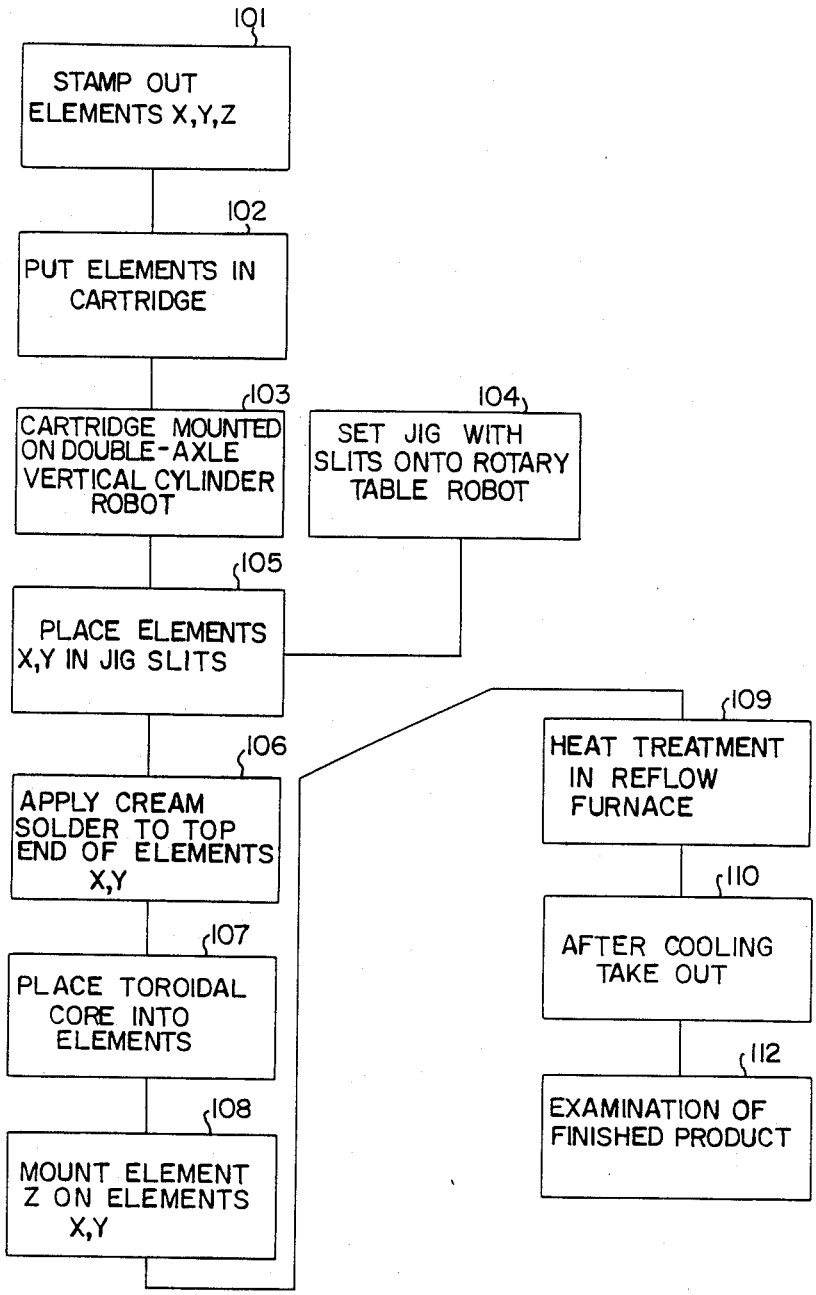
FIG. 10 is a flow chart of a manufacturing process of the toroidal coil.
Figure 11:
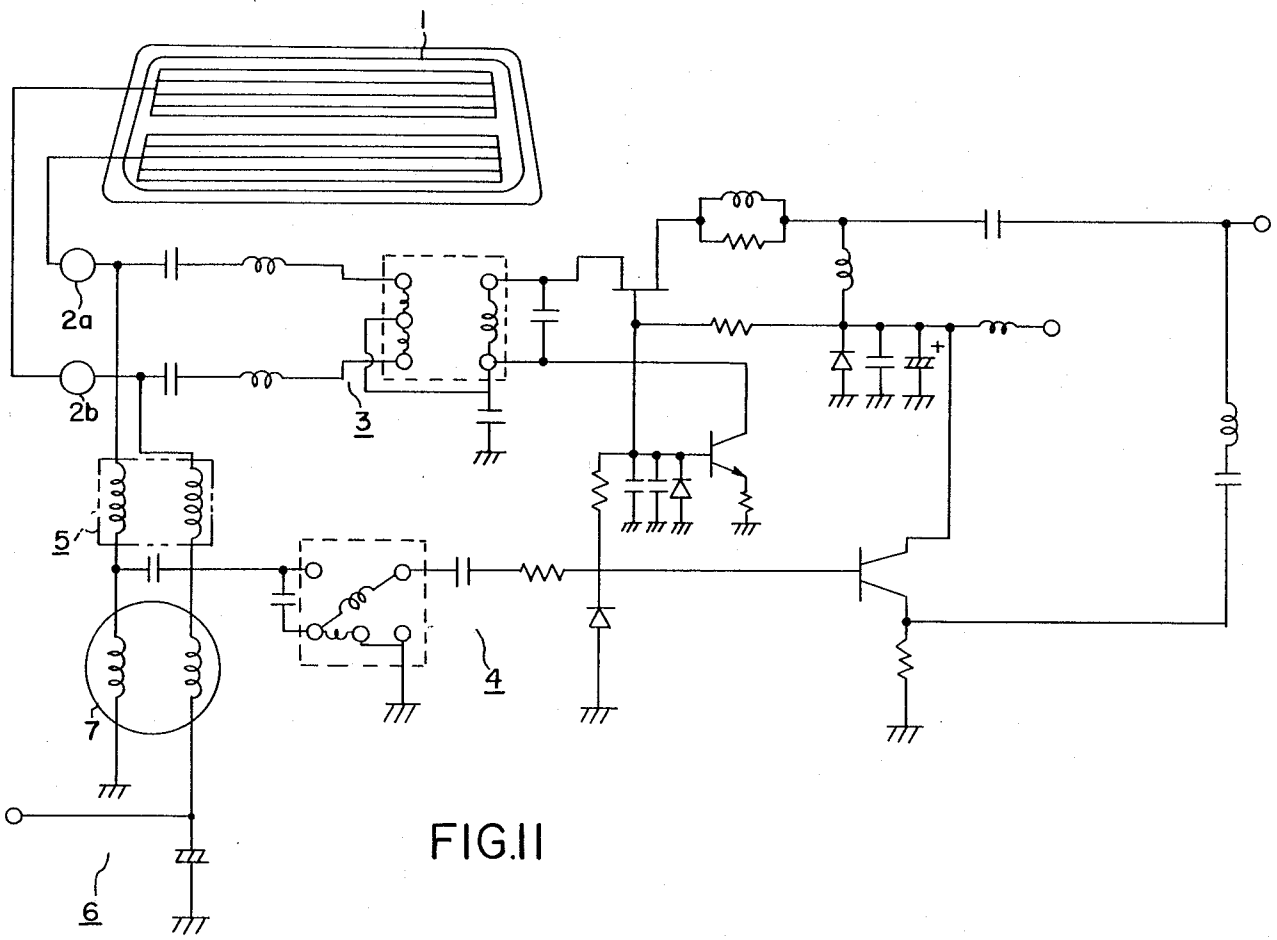
FIG. 11 is a circuit diagram of a radio receiver for automobiles.

In Step 101, shown in FIG. 10, the elements X, Y, and Z are cut out be a press machine.

Figure 8:
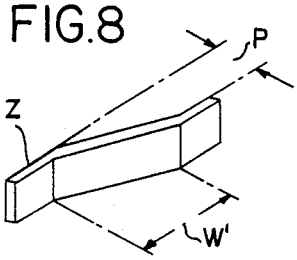
FIG. 8 is a perspective view of an element Z.
Figure 6:
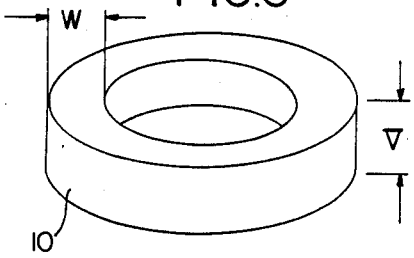
FIG. 6 is a perspective view of a toroidal core.

In Step 102, these elements are put in a cartridge, and in Step 103 the cartridge is mounted on a double-axle vertical cylinder robot. The robot is set so that the elements X and Y shown in FIGS. 3(*a*) and 3(*b*) are taken out first and then the element Z shown in FIG. 8 is taken out.

In step 104, a jig 40 which is provided with slits, as shown in FIG. 4, is set on a rotary table robot.

Figure 5:
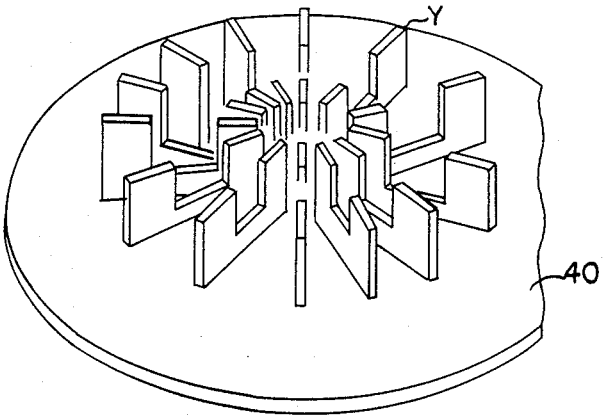
FIG. 5 is a perspective view of the jig with the element Y placed in the slits.

In step 105, the double-axle vertical cylinder robot and the rotary table robot are simultaneously operated so that the jig 40 is rotated in the direction of the arrow in FIG. 4 and the bottoms of the elements X and Y are placed in the slits of the jig 40. In this case, a plurality of the elements X are placed in the slits where the coil terminals are positioned, and a plurality of elements Y are placed in the other slits. FIG. 5 shows such an arrangement of the elements. In FIG. 5, only elements Y are shown and elements X are omitted.

In step 106, cream solder is applied to on the end portions, that is to the top end, of the elements X and Y using a conventional method.

Figure 7:
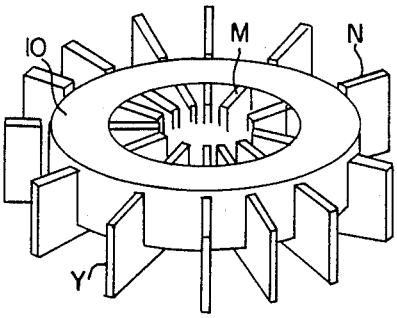
FIG. 7 is a perspective view of the toroidal core placed in the element Y of FIG. 5.

In step 107, the ring shaped toroidal core 10, having a thickness V and a width W, is placed in theelements Y as shown in FIG. 7. The jig 40 is not shown in FIG. 7.

In step 108, the elements Z, as shown in FIG. 8, are mounted on the top of the elements X and Y which are covered with cream solder. The element Z is S-shaped and has an intermediate bent portion. This intermediate bent portion has a pitch P which is equal to the distance between the first conductive members, that is the elements X and Y, which are arranged on the core 10. The length W′ of the intermediate bent portion of the element Z is equal to the width W of the core 10.

Figure 9:
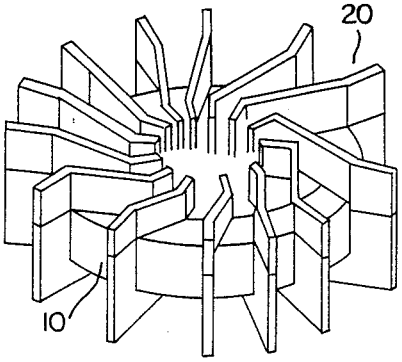
FIG. 9 is a perspective view of the element Z placed on the toroidal core of FIG. 7.

Since the element Z is S-shaped, one end of the element Z can be precisely mounted on the inner top end M of the element Y (or X) and the other end thereof can also be precisely mounted on the outer top end N of the next element Y (or X) so that the elements X and Y are continuously connected by the elements Z. FIG. 9 shows the elements Z mounted on the top ends of the elements X and Y on which the cream solder has been applied. The jig 40 is not shown in FIG. 9.

In step 109, the toroidal coil device, thus assembled as shown in FIG. 9, is heat treated at about 300 C in a reflow furnace so that the elements Y (or X) and theelements Z are fastened by cream solder which has been applied in advance. Thus, the elements are electrically connected to create the toroidal coil 20.

In step 110, after cooling, the toroidal coil 20 is taken out of the furnace, and thejig 40 is removed.

Instep 112, the toroidal coil 20 is examined. Thus, all the required steps are completed, and the toroidal coil is a finished product.

By completing the above described steps, the toroidal coil shown in FIG. 1 is obtained. In addition, all of the steps can be carried out by robots.

As explained above, according to the embodiment of the present invention, the work necessary to wind the coil on a core is eliminated, and coil conductors of any diameter can be used by merely varying the sizes of the elements X, Y, and Z and the core 10. Accordingly, even if the diameter of the coil conductor is very large, a toroidal coil can be manufactured without any trouble. Further, with this method a toroidal coil which is free of uneven coil windings and has high precision coil windings is easily and accurately provided.

The present invention should not be limited to the embodiment described above. In the embodiment, the first conductive members 21 (elements X and Y) and the second conductive members 22 (element Z) are fastened by cream solder. Other methods of fastening the elements such as the spot welding, electronic beam welding, etc. can be used for connecting the elements.

According to the present invention, a toroidal coil device can be obtained without winding coils on the core. Irrespective of the diameters of the coils it is possible to provide a toroidal coil device which has an even and high precision coil winding.

Also, according to the present invention, a toroidal coil can be manufactured automatically. Thus, the present invention provides a method for easily and accurately manufacturing a toroidal coil device which has the above-described features.

It should be apparent to those skilled in the art that the above described embodiments are merely an illustration of the many possible specific embodiments which represent the application of the principles of the present invention. Numerous other arrangements can be readily devised by those skilled in the art without departing from the spirit and scope of the invention.

I claim:

1. A method for manufacturing a pair of toroidal coils for radio frequency antennas comprising the ordered steps of:

forming first conductive members in a U-shape and second conductive members in an S-shape.

placing the bottom of each of said U-shaped first conductive members in slits formed in a jig, said slits being arranged at equal predetermined intervals in a circumferential direction on said jig;

placing a ring shaped ferrite core in said U-shaped first conductive members;

mounting said second conductive members on upper ends of said first conductive members, each of said second conductive members being electrically connected to one end of one of said first conductive members and to the other end of another first conductive member; and electrically fastening said second conductive members to said first conductive members.

2. A method according to claim 1, further comprising a step of putting cream solder on said upper ends of said first conductive members.

3. A method of manufacturing a pair of toroidal coils for radio frequency antennas comprising the ordered steps of:

stamping out of a highly electrically conductive metal first conductive members in a U-shape and second conductive members in an S-shape;

placing said first conductive members in a cartridge;

mounting said cartridge on a double-axel vertical cylinder robot;

mounting a jig provided with slits formed therein at equal predetermined intervals in a circumferential direction on a rotary table;

operating said double-axel vertical cylinder robot and said rotary table robot to place a bottom of each of said U-shaped first conductive members in said slits of said jig;

applying cream solder to upper ends of said first conductive members;

inserting a ring-shaped ferrite core in said U-shaped first conductive members;

operating said double-axel vertical cylinder robot and said rotary table robot to place said second conductive members on said upper ends of said first conductive members, each of said second conductive members being placed on one end of one of said first conductive members and on the other end of another of said first conductive members;

placing said jig with said first and second conductive members in a furnace;

heating said jig with said first and second conductive members to melt said cream solder to electrically and mechanically couple together said first and second conductive members to form said pair of toroidal coils;

removing said jig with said pair of toroidal coils from said furnace and cooling said jig with said pair of toroidal coils thereon; and removing said paid of toroidal coils from said jig.

* * * * *

UNITED STATES PATENT AND TRADEMARK OFFICE

CERTIFICATE OF CORRECTION

PATENT NO. : 4,878,291

DATED : November 7, 1989

INVENTOR(S) : Kazuhiko Suguri

It is certified that error appears in the above-identified patent and that said Letters Patent is hereby corrected as shown below:

On the title page;

Foreign Application Priority Data

April 30, 1987 [JP] Japan ..... 62-106864[P]

Signed and Sealed this

Twenty-fifth Day of February, 1992

*Attest:*

HARRY F. MANBECK, JR.

*Attesting Officer*

*Commissioner of Patents and Trademarks*